United States Patent [19]

Street et al.

[11] 4,254,414

[45] Mar. 3, 1981

[54] PROCESSOR-AIDED FIRE DETECTOR

[75] Inventors: Thomas T. Street, Springfield; John I. Alexander, Vienna, both of Va.

[73] Assignee: The United States of America as represented by the Secretary of the Navy, Washington, D.C.

[21] Appl. No.: 23,043

[22] Filed: Mar. 22, 1979

[51] Int. Cl.[3] ..... G08B 17/00

[52] U.S. Cl. ..... 340/627; 340/628; 73/28; 364/555

[58] Field of Search ..... 340/627, 628, 629, 630; 73/28; 235/92 PC, 92 EV; 364/555

[56] References Cited

U.S. PATENT DOCUMENTS

| | | | |
|---|---|---|---|
| 3,678,487 | 7/1972 | Ludewig, Jr. et al. | 340/628 |
| 3,728,615 | 4/1973 | Hill et al. | 340/628 |
| 3,795,899 | 3/1974 | Cade | 340/628 |
| 3,953,844 | 4/1976 | Barr et al. | 73/28 |
| 4,005,754 | 2/1977 | Linden et al. | 340/628 |
| 4,035,788 | 7/1977 | Barr | 340/627 |
| 4,151,522 | 4/1979 | Yamauchi | 340/628 |
| 4,162,489 | 7/1979 | Thilo et al. | 340/628 |

*Primary Examiner*—Gerald L. Brigance

*Attorney, Agent, or Firm*—R. S. Sciascia; William T. Ellis; Vincent J. Ranucci

[57] ABSTRACT

A fire detection system which includes an environmental sampling assembly coupled to a programmable digital processor for detecting a threat of fire and reducing the occurrences of false alarms in a changing environment. The sampling assembly comprises a network of air ducts, a chamber, two sensors, and an exhaust fan. The processor includes two analog-to-digital (A/D) converters, a multiplexed digital summer, short and long-term storage mediums, a signal magnitude comparator, logic circuitry, and a timing generator. The fan continuously draws ambient air through the air ducts and the chamber. Sensors within the chamber sample the air. If the sensors detect particulates of combustion in the air, the sensors provide electrical signals of varying amplitudes, which amplitudes depend on the number and sizes of the particulates being sampled, to the A/D converters of the processor. One of the sensors also feeds its signals to the fan motor for increasing the speed of the fan, thereby clearing the chamber and drawing air through the chamber at a faster rate for a more vigorous sampling of the environment. The processor may be programmed to suit a specific environment. It monitors the amplitudes of the signals from the assembly and the rate and duration of changes in the amplitudes by comparing signal samples at successive intervals of time. The processor activates a four-level, visual alarm which indicates the progression or regression of a threat of fire.

4 Claims, 6 Drawing Figures

PROCESSOR-AIDED FIRE DETECTOR

BACKGROUND OF THE INVENTION

This invention relates generally to fire detectors and more particularly to a fire-detection system which provides optimum sensitivity to a threat of fire and minimizes the occurrences of false alarms during changing environmental conditions.

Existing fire and smoke detectors perform satisfactorily in a relatively constant environment. However, when these detectors are exposed to a frequently changing environment, such as a machine shop, rooms containing smoking personnel and/or machines which emit oil, smoke, or other particulate matter, or abroad ship where various locations encounter temperature, humidity, and air flow extremes, they produce a high percentage of false alarms in comparison to actual threats of fire, and thus perform unsatisfactorily. Also, under such changing environmental conditions, existing fire detectors may require frequent servicing due to the collection of particulates within a detector.

Some existing fire and smoke detectors compare output signals of sensors with a preselected threshold signal level and sound an alarm if the output signals exceed the threshold level. The greater the sensitivity of such detectors, the more the detectors may give false alarms. If such detectors are adjusted to a lower sensitivity, a threat of fire may be allowed to escalate.

SUMMARY OF THE INVENTION

The general purpose and object of the present invention is to provide a highly reliable fire detection system which maintains a high level of sensitivity and stability, and greatly reduces the occasions of false alarms while operating in a frequently changing environment. This and other objects of the present invention are accomplished by an environmental sampling assembly coupled to a programmable digital processor. The sampling assembly continously draws ambient air through its system and samples the air to detect particulate matter. If such matter is detected the assembly sends electrical signals, the amplitudes of which correspond to the number and sizes of the particulates, to the processor. Simultaneously, the assembly draws ambient air through its system at a faster rate for quickly clearing itself of any transitory, non-fire-threatening particulates and for more actively sampling the air.

The processor receives the electrical signals from the assembly and performs the following functions: it converts the signals to digital samples, and sums the amplitudes of the samples over an interval of time; forms such sums for successive time intervals; compares the magnitude of the sum for the most recent time interval, that is, the present sum, with the magnitude of the sum immediately preceding the present sum, that is, the previous sum, to determine if the magnitude is increasing, decreasing, or remaining constant; stores the magnitude of the present sum; stores the results (increase, decrease, remain constant) of the comparisons between present and previous sums for a number of the most recent time intervals; maintains an average count of continuous results of such comparisons to determine the trend of the amplitudes of the signals, that is, to determine if the magnitudes of the sums, and, therefore, the signals from the assembly, have been increasing, decreasing or remaining constant; analyzes the magnitude of the present sum, the results of comparisons between present and previous sums for a number of the most recent time intervals, and the trend of the amplitudes of the signals; and activates a four-level visual alarm to indicate the progressing or regressing stages of a threat of fire. The processor may be programmed, that is, wired, to react to any suitable set of the aforementioned parameters, such as the number of most recent time intervals, the length of a time interval, the sampling rate, etc.

The novel features of the invention are: forcing air through a sampling assembly, sampling the air to detect particulate matter therein, increasing the rate of air flow and the rate of sampling to determine if the particulates are merely transitory or are continuously present in the environment, and providing output signals having amplitudes which correspond to the sizes and amount of particulates; and using a programmable digital processor which includes A/D converters, a multiplexed digital summer, short and long-term storage mediums, a signal-magnitude comparator, logic circuitry, and a timing generator for monitoring the amplitudes of the output signals to detect changes in those signals over intervals of time which are sufficient to suggest a threat of fire, and for activating four levels of alarm to indicate the progression or regression of the threat.

The advantages of the processor-aided fire detector are: it provides optimum sensitivity to a threat of fire, yet is effective against false alarms caused by changing environmental conditions; four levels of alarm afford precautionary measures against progressively greater threats of fire; the processor is programmable to suit the location of the detector since different parameters may be required to detect fires at different locations; and the detector can operate over prolonged periods of time with infrequent servicing, even in typically polluted environments, because of the continuous forced flow of air through the sampling assembly.

Other objects and advantages of the invention will become apparent from the following detailed description of the invention when considered in conjunction with the accompanying drawing wherein:

DETAILED DESCRIPTION

Figure 1:
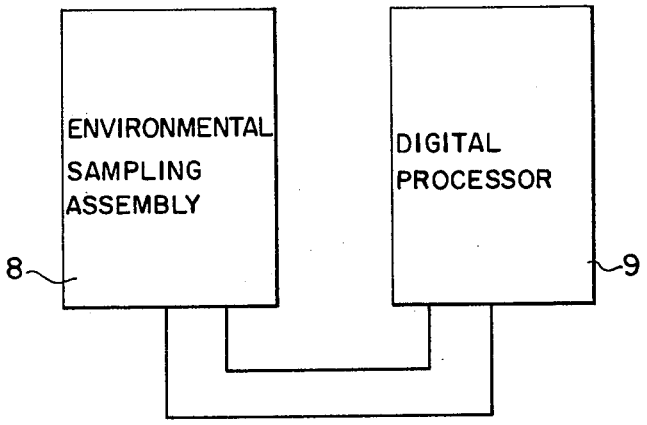
FIG. 1 is a simplified block diagram of the fire detector which includes an environmental sampling assembly and a digital processor.
Figure 2:
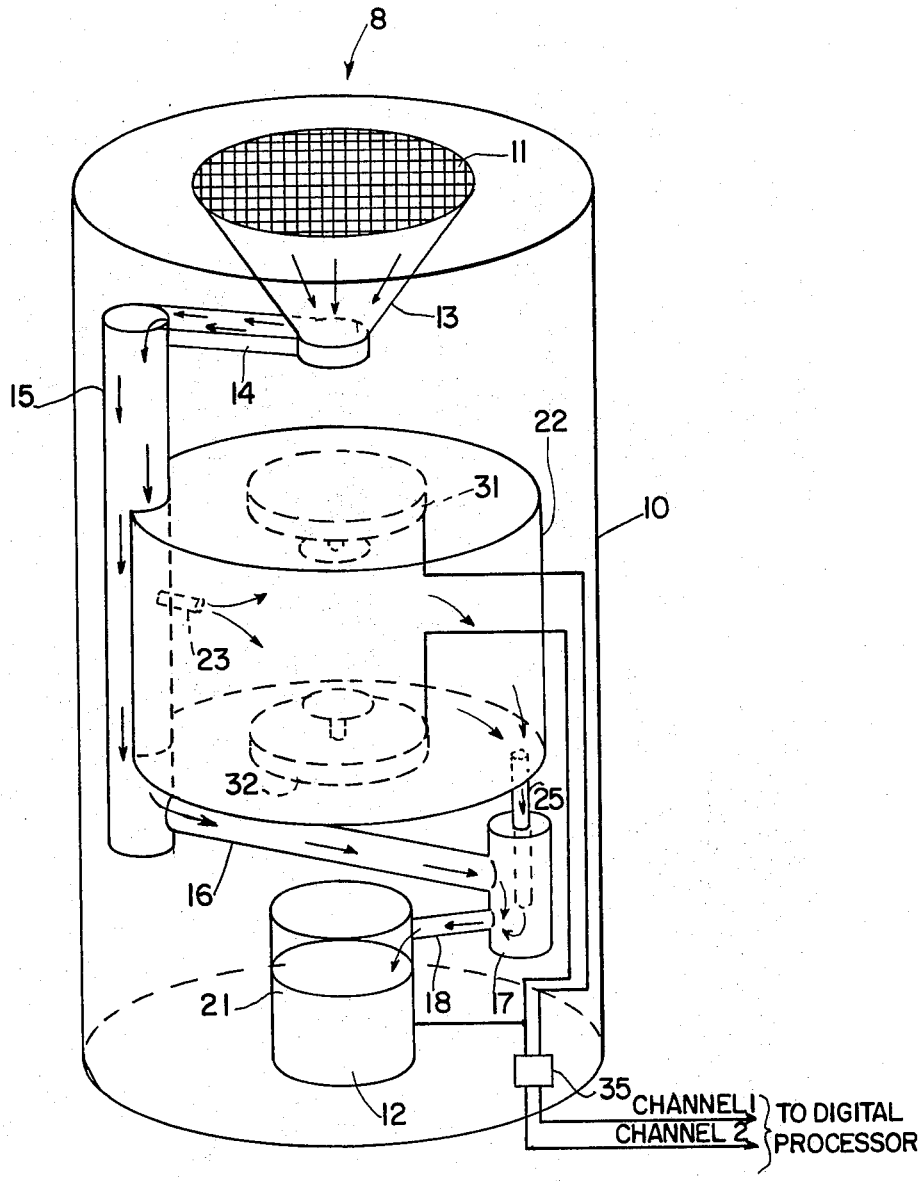
FIG. 2 illustrates a schematic view of the environmental sampling assembly.

The fire detector includes an environmental sampling assembly 8 coupled to a digital processor 9 as shown in FIG. 1. The sampling assembly 8, as depicted in FIG. 2, includes a cylindrical housing 10 made of any suitable material. The housing 10 is closed on each end and includes an coaxially aligned inlet 11 and an outlet 12 in opposite ends of the housing. The inlet 11 is joined by a conical-shaped air inlet 13 which is secured within the housing with its apex end directed inwardly away from the inlet 11. The apex end of the conical inlet 13 is joined with and opens into one end of an air duct 14 which joins with an air duct 15 located near the inner wall surface of said cylindrical housing and extends parallel with the housing linear axis. The opposite end of air duct 15 connects with a duct 16 which extends across the cylindrical housing to join with a suction chamber 17. An air duct 18 connects the suction chamber 17 to a motor-driven fan 21 whose output is secured to the outlet 12 of the cylindrical housing.

Within the cylindrical housing 10 and between air ducts 14 and 16, an environmental sampling chamber 22 is secured alongside air duct 15. A siphon tube 23, which is much smaller than air duct 15, extends into the sampling chamber 22 on one side at the mid-point of the sampling chamber and is secured in air-flow communication to the air duct 15. A suction tube 25 having substantially the same diameter as the siphon tube 23 is connected at one end to the lower end of the sampling chamber 22 and extends into the suction chamber 17 along the linear axis of the suction chamber to a point below the connection of air duct 16.

Figure 3:
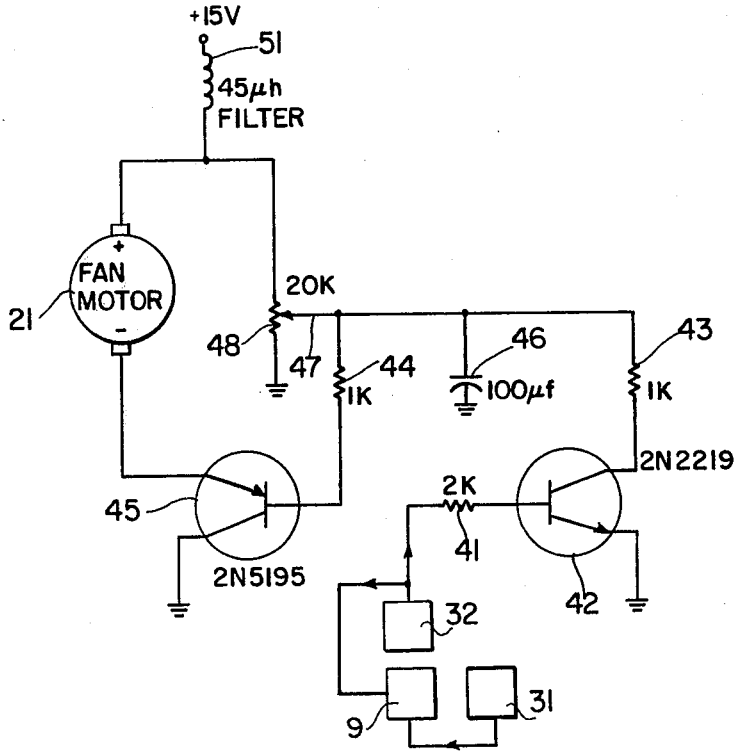
FIG. 3 is a schematic diagram of an electrical circuit for controlling the speed of the fan motor of the environmental sampling assembly.
Figure 4:
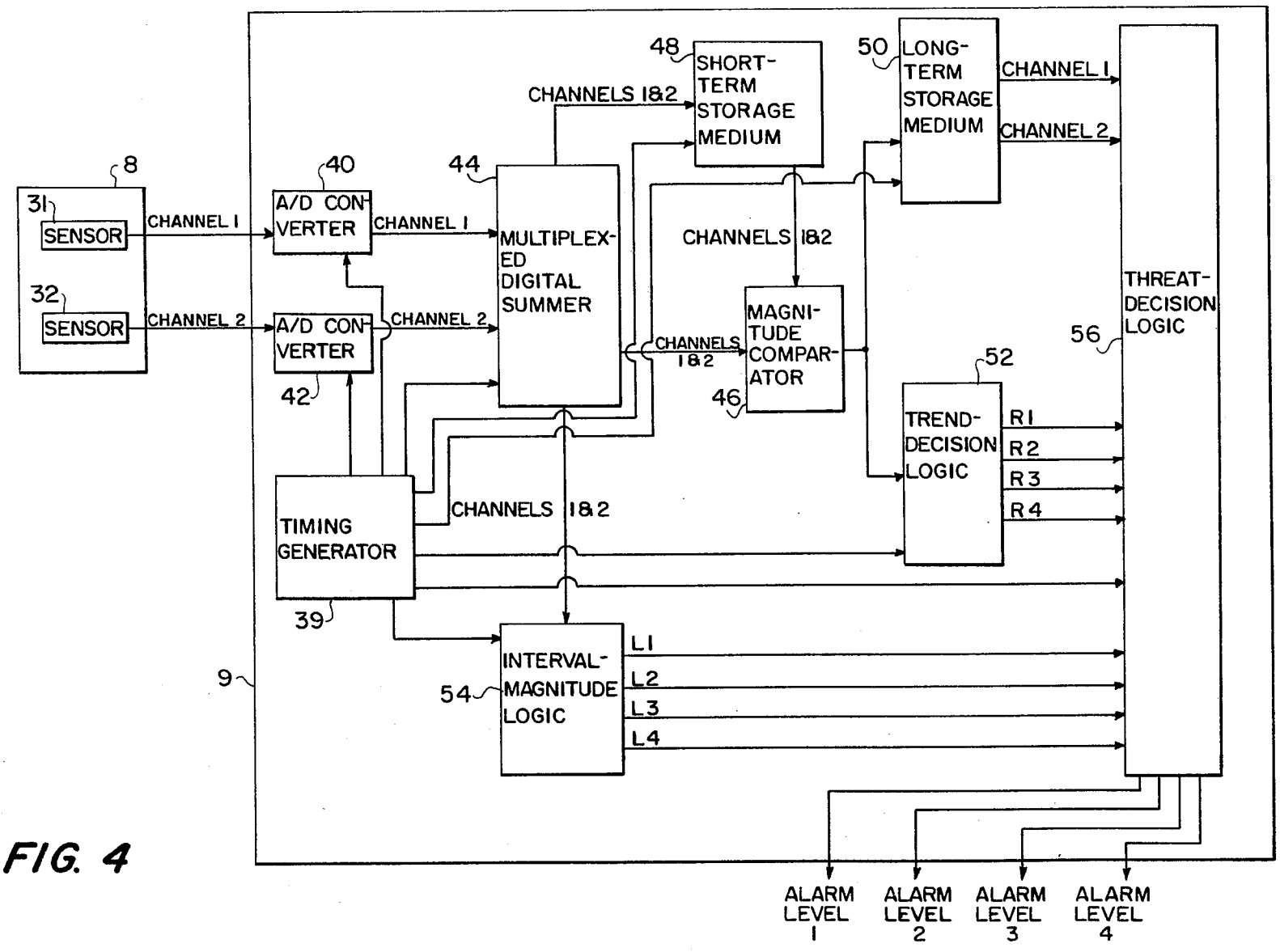
FIG. 4 is a block diagram of the digital processor.

The sampling chamber 22 includes therein two oppositely disposed smoke sensors 31, 32 which may be of any desired type but preferably are ionization sensors, such as Pyrotronics model D7. The sensors 31, 32 are mounted on the upper and lower walls of the chamber 22 in coaxial alignment with the chamber and face each other. (The chamber 22 is not necessarily coaxial with the cylindrical housing 10.) Outputs from the sensors 31, 32 are connected, for example, through a connector 35 at the outlet end of the housing 10, to a digital signal processor 9 which is shown in FIG. 4 and will be discussed subsequently. Additionally, the output from the sensor which is nearer to the fan 21, that is, sensor 32 in FIG. 2, is applied to a fan-motor control circuit which is shown in FIG. 3.

The fan-motor control circuit is designed to increase the speed of the motor when the sensor 32 detects an input of particulate matter. As shown in FIG. 3, the output from the sensor 32 is transmitted through a 2K resistor 41 to the base of a 2N2219 transistor 42. The emitter of the transistor is grounded and the collector is connected through a 1K resistor 43 and a 1K resistor 44 to the base of a 2N5195 transistor 45. A 100 μf capacitor 46 is connected to the electrical line between the two resistors 43 and 44 and to ground. The electrical line to the input end of the resistor 44 is connected to the movable contact 47 of a 20K potentiometer 48 which connects at one end to ground and at the other to the positive side of the fan motor 21. The negative side of the fan motor is connected to the emitter of transistor 45 and the collector of the transistor 45 is grounded. A 45 μh inductor 51 filters the supply voltage to the fan motor and is shown connected to the line between the potentiometer and the motor with an applied operating voltage of 15 volts.

In operation of the fan-motor control circuit, a portion of the output of the sensor 32, is directed to the base of transistor 42 through resistor 41. Transistor 42 drives transistor 45. Transistor 45 serves to control the current to the motor 21 and, therefore, the speed of the motor. The 20K potentiometer 48 sets the threshold at which the motor speed will change in response to the applied analog signal from the sensor 32.

In operation of the environmental sampling assembly 8 of FIG. 2, the fan 21 draws ambient air, at an initial speed, which is suitable for adequately sampling the environment, into inlet 11 and through the air duct system. As the air flows through the suction chamber 17 from duct 16 and into duct 18, the air flow creates suction on the suction tube 25. This suction causes some of the air flowing through duct 15 to flow through the siphon tube 23, through the sampling chamber 22, and through the suction tube 25 to combine with the air flow in the suction chamber 17. The common flow of air then passes through duct 18 and exits by way of the outlet 12. Relatively heavy particles, such as dust, experience little influence at the siphon tube 23 as they flow through duct 15. This is due to their greater momentum than that of lighter particles, and because the siphon tube 23 is approximately perpendicular to the duct 15, and the flow of air in the duct 15 is greater than that in the siphon tube. Therefore, substantially only light particulate matter enters the sampling chamber 22. The sensors 31, 32 sample the air in the sampling chamber 22. If the air in the chamber 22 includes particulates which may indicate a threat of fire, the sensors 31, 32 produce analog signals which are sent on channels 1 and 2, respectively, to the processor 9. The output signal from the sensor 32 is also fed to the fan-motor control circuit. As mentioned previously the speed of the fan increases in response to the output from the sensor 32. The increased speed of the fan causes the air to flow faster throughout the ducts. This creates a greater suction at the suction tube 25 and siphon tube 23 and increases the flow of air through the sampling chamber 22. The faster air flow more rapidly clears the chamber 22 of transitory particulates, such as cigarette smoke, which are not representative of a true fire. After clearing the chamber 22 of such particulates, the fan returns to its initial speed. If, however, the presence of particulates which may represent a threat of fire is relatively continuous in the chamber, the sensors continue to provide output signals and the speed of the fan remains at higher levels for a more vigorous sampling rate and a more reliable detection of fire.

The digital processor 9 shown in FIG. 4 receives analog signals from sensors 31, 32 of the sampling assembly 8. The processor includes a timing generator 39, two analog-to-digital (A/D) converters 40, 42, a multiplexed digital summer 44, a comparator 46, a short and a long-term storage medium 48, 50, respectively, a trend-decision logic circuit 52, an interval magnitude logic circuit 54, and a threat-decision logic circuit 56.

The timing generator controls the sampling rate of the A/D converters, the clock circuits of the multiplexed summer, the strobes to the short and-long-term storage mediums, and the strobes to the trend-decision logic, interval-magnitude logic, and threat-decision logic circuits.

The A/D converters 40 and 42 receive the analog signals on channels 1 and 2 respectively, and from sensors 31 and 32, respectively. Each A/D converter samples the output of its associated sensor every 0.5 seconds within successive 5-second time intervals. The sampling is performed by each converter on an alternate basis, for adapting with a multiplexer which will be discussed subsequently, so that both sensors are sampled ten times during a same 5-second interval. The amplitude of each sample, which corresponds to the analog voltage of the signal, is represented at the output of each converter by a number in binary form which corresponds to 0 through 15, that is 0000 through 1111. Each converter feeds the amplitude of each sample to the muliplexed digital summer 44. The multiplexed summer comprises, for example, a multiplexer, two adders and four latches, where each adder is coupled to two latches. The latches in the multiplexed summer maintain the separation of channels 1 and 2 in the summer. The timing generator provides clock pulses to the remaining sections of the processor for isolating channel 1 from channel 2. The summer adds the amplitudes of ten samples from each converter per interval, such a summation being in the range of 0 through 150. The summer then transfers the summation for each channel to the short-term storage medium, the comparator, and the interval magnitude logic circuit. Thus, at the end of each interval the summer outputs a number in the range of 0 through 150 for each channel.

The short-term storage medium includes, for example, two sets of latches, and it stores each summation for each channel for one 5-second interval. A summation from a channel thus stored may be described, for purposes of discussion, as a previous sum, whereas a summation from the same channel which is immediately fed from the summer may be termed a present sum. The comparator compares the magnitude of the previous sum of a channel with the magnitude of the present sum of the same channel, that is, it compares the output of the short-term storage medium with the output of the summer. If the previous sum is equal to or greater than the present sum, the comparator causes a "0" to be both stored in the long-term storage medium for the particular channel and sent to the trend-decision logic circuit by strobe from the timing generator. If the previous sum is less than the present sum, the comparator causes a "1" to be both stored in the long-term storage medium for the particular channel and sent to the trend decision logic circuit by strobe from the timing generator. The long-term storage medium comprises, for example, two shift registers (one per channel). It stores concurrently the results of signal magnitude comparisons for a number, eight for example, of intervals for each channel, or sixteen "1"'s and/or "0"'s for both channels in this example, and does so with a sliding window method, that is, it gains the most recent "0" or "1" for each channel and loses the oldest "0" or "1" for each channel. It provides this information to the threat-decision logic.

The trend-decision logic circuit comprises an up-down counter, hereinafter referred to as the counter, which is controlled by the comparator. The counter determines whether the summations on each channel are increasing, decreasing, or remaining the same. The counter steps up one count every time the present sum on either channel exceeds the previous sum on either channel, that is, when the counter receives a "1" from the comparator by stobe from the timing generator, until the counter reaches a maximum count of 15 where it will remain until it receives a down count from either channel which occurs when the present sum is less than the previous sum. The counter steps down one count every time the present sum on either channel is less than the previous sum on either channel until it reaches a count of 0 where it will remain until it receives an up count from either channel, that is, when the present sum exceeds the previous sum. When the counter goes up at least one time and then the comparator determines that the present sum is equal to the previous sum, both sums being from the same sensor, that is, on the same channel, the counter will count up one time for each successive equivalent sum. Similarly, when the counter goes down at least one time and then the present sum is equal to the previous sum, both sums being from the same sensor, the counter will count down one time for each successive equivalent.

The counter decodes its counter states of 1 through 15 into outputs which are labeled, for example, R1, R2, R3, and R4. The outputs are decoded as follows:

| Counter State | Decoded Output |
|---|---|
| 1 | R1 |
| 2 | R1 |
| 3 | R1 |
| 4 | R1 + R2 |
| 5 | R1 + R2 |
| 6 | R1 + R2 |
| 7 | R1 + R2 |
| 8 | R1 + R2 |
| 9 | R1 + R2 + R3 |
| 10 | R1 + R2 + R3 |
| 11 | R1 + R2 + R3 |
| 12 | R1 + R2 + R3 + R4 |
| 13 | R1 + R2 + R3 + R4 |
| 14 | R1 + R2 + R3 + R4 |
| 15 | R1 + R2 + R3 + R4 |

These outputs correspond to the length of time that the signals from the sensors 31, 32 have been increasing or decreasing. The counter feeds these outputs to the threat-decision logic circuit.

The interval-magnitude logic circuit, for example, a magnitude decoder and a quad latch, monitors the magnitude of each summation for each channel per interval. It receives the magnitude, having a range of 0 through 150, of each summation from the summer, and decodes the magnitude into outputs which may be labeled L1, L2, L3, and L4. The outputs are decoded as follows:

| Approximate Percent of Maximum Magnitude (150) | Magnitude of Summation | Decoded Output |
|---|---|---|
| greater than 10% | greater than 15 | L1 |
| greater than 20% | greater than 31 | L2 |
| greater than 42% | greater than 63 | L3 |
| greater than 74% | greater than 111 | L4 |

The interval-magnitude logic circuit feeds the decoded information to the threat-decision logic circuit.

The threat-decision logic circuit includes, for example, a latch and a number of logic gates. It constantly analyzes the inputs from the long-term storage medium (a number of comparisons of the magnitude of the signals from the sensors for a number of most recent time intervals), the counter (an average value of signal magnitude comparisons which determines whether the signals have been increasing, decreasing or remaining constant), and the interval-magnitude logic circuit (the magnitude of the signals for the most recent time interval, that is, the past five seconds). The threat-decision logic circuit provides four levels of alarm based on its analysis of the aforementioned parameters. The alarm includes four visual indicators, such as lights. However, the alarm may be any suitable form, such as audio, where the four levels of alarm may be represented by sounds of four different frequencies.

The first level of alarm (one light) indicates a change in the environment which is not necessarily a threat of fire but which suggests caution at an early stage. If there is at least one "1" stored in either of channels 1 or 2 of the long-term storage medium, the first level of alarm will be activated. When the long-term storage medium stores eight intervals of information, the first level of alarm will be in the "on" position for at least forty seconds, that is, five seconds per stored interval.

The second level of alarm (two lights) indicates a mild to moderate change in the environment and may imply that the location of the detector should be inspected. Level two requires L2 and R1+R2 from the interval magnitude logic circuit and the counter, respectively, and any number of "1"'s per channel, as programmed to suit the environmental conditions associated with the location of the detector, from the long-term storage medium.

The third level of alarm (three lights) indicates a fire at an early stage. Level three requires L3 and R1+R2+R3 from the interval-magnitude logic circuit and the counter, respectively, and any number of "1"'s per channel, as programmed, from the long-term storage medium.

The fourth level of alarm (four lights) indicates an extreme hazard of fire. Level four requires L4 and R1+R2+R3+R4 from the interval-magnitude logic circuit and the counter, respectively, and any number of "1"'s per channel, as programmed, from the long-term storage medium.

The processor is programmable. Therefore, the aforementioned parameters, such as the sampling rate of 0.5 seconds, the five second time interval, and the storage of eight intervals of information by the long-term storage medium, may be varied to suit any desired operating conditions.

The environmental sampling assembly and the processor may be powered by dc power supplies (not shown) located in the processor.

The environmental sampling assembly and the processor are typically, but not necessarily, located in close proximity to each other. The alarm may be part of the processor or may be placed at a remote location. A number of detector systems may be monitored from one location by placing the alarm (four lights) for each processor at a common panel.

The processor-aided fire detector is a reliable and versatile detection system which is suitable for one room or for a number of rooms, as for example, aboard ship. Each detector may be programmed to accommodate any environmental conditions which are peculiar to a specific location. The detector discriminates against false alarms while providing optimum sensitivity to a threat of fire.

Figure 5A:
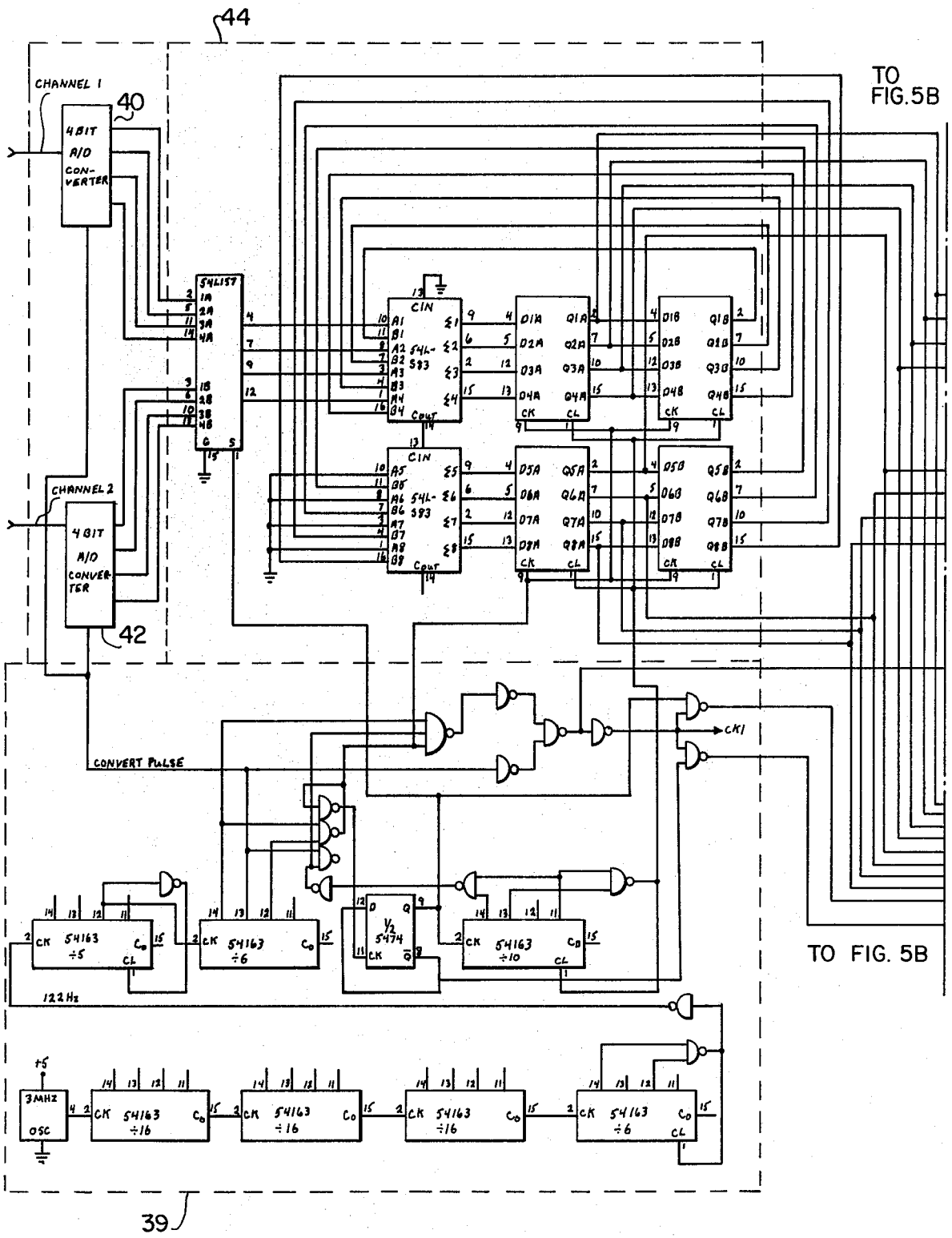
FIGS. 5A and 5B are a schematic diagram of the electronic circuitry of the digital processor.
Figure 5B:
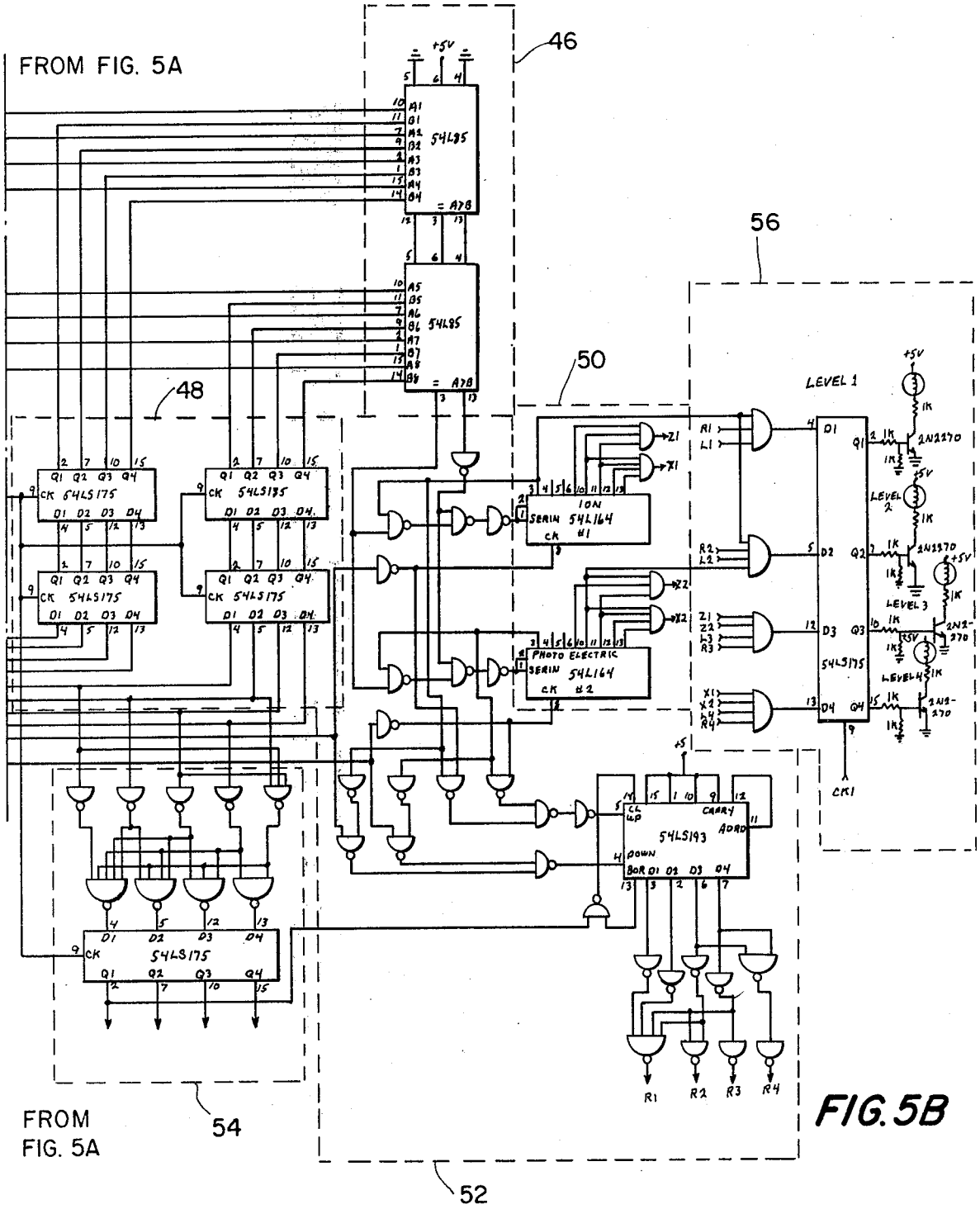

FIG. 5 shows a possible implementation of the aforementioned parts of the processor which are depicted in FIG. 4. One skilled in the art of logic circuitry can make the processor to suit any particular environmental conditions from the aforementioned description of the processor and from FIGS. 4 and 5. The standard manufacturer part number of the components shown in FIG. 5 are identified as follows:

- multiplexed digital summer
  - 54L157 (quantity 1) two line-to one line multiplexer
  - 54LS83 (quantity 2) single 4 bit full adder
  - 54LS175 (quantity 4) quadruple D type register (latch)
- short-term storage medium
  - 54LS175 (quantity 4)
- long-term storage medium
  - 54L164 (quantity 2) 8 bit serial N parallel out shift register
- signal magnitude comparator
  - 54L85 (quantity 2) 4 bit magnitude binary comparator
- interval-magnitude logic circuit
  - 54LS175 (quantity 1)
  - NAND gates (quantity 9)
- counter
  - 54LS193 (quantity 1) 4 bit binary synchronous counter
  - NAND gates (quantity 28)
- threat-decision logic circuit
  - 54LS175 (quantity 1)
  - NAND gates (quantity 4)
- timing generator
  - 54163 (quantity 7) synchronous binary counter
  - 5474 (quantity 1) flip flop for dividing by two Obviously many more modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A system for detecting a threat of fire in a frequently changing environment and discriminating against false alarms comprising:

means for sampling ambient air to detect an average amount of particulate matter in the environment, said sampling means including:

duct means for conveying a common flow of said ambient air;

a chamber coupled to said duct means for collecting samples of said ambient air;

siphoning means coupled between said duct means and said chamber for abstracting said samples of the ambient air;

suctioning means coupled between said chamber and said duct means for returning the samples of the ambient air to said common flow in said duct means; and means for forcing said ambient air through said duct means at a rate of speed, said rate being increased as the particulate matter increases within said chamber to more vigorously sample the ambient air and to determine an average amount of said particulate matter in the environment, said increased rate being decreased as the increased particulate matter decreases within said chamber, said means for forcing the ambient air using different rates of speed for determining a required time for environmental conditions within said chamber to be similar to environmental conditions outside the chamber, such that the required time effectively averages the environmental conditions within the chamber to determine if the environmental conditions outside the chamber present a threat of fire;

two or more sensing means disposed within said sampling means for converting the amount of said particulate matter into electrical signals whose amplitudes are representative of the density of the particulate matter, a first of said sensing means feeding its signals to said means for forcing the ambient air for changing said rate of speed; and signal processing means for receiving said electrical signals from said two or more sensing means to monitor information comprising a change in the amplitudes of said signals as indications of the progressive and regressive levels of a threat of fire, said signal processing means for storing the information over successive time intervals, and comprising subsequently stored information with previously stored information to determine a rate at which the amounts of particulate matter in the environment increase and decrease, and instantaneous magnitude of the particulate matter in the environment, and a duration of time during which said amounts of particulate matter exist in the environment, said system determing a normal environmental condition over a period of time and distinguishing a short-term abnormal environmental condition from a long-term threat of fire.

2. The system of claim 1 wherein said two or more sensing means includes first and second sensors oppositely disposed within said chamber, each of said sensors converting the density of said particulate matter into said electrical signals.

3. The system of claim 1 wherein said means for forcing said air through said duct means includes a fan, said fan being driven by a control circuit which receives said electrical signal from said first sensing means and increases said rate of speed as the particulate matter increases within said chamber, said increased rate of speed being decreased as the increased particulate matter decreases within said chamber.

4. The system of claim 1 wherein said signal processing means includes:

analog-to-digital converter means for receiving and digitizing the electrical signals from said sensing means over successive intervals of time;

multiplexed digital summer means for receiving and summing outputs of said analog-to-digital converter means for each of said intervals of time;

interval-magnitude logic means for receiving and decoding the amplitude of the output of said multiplexed digital summer means to represent a percentage of the maximum possible amplitude of said output of said multiplexed digital summer means;

short-term storage means for successively receiving and storing the output of said multiplexed digital summer means for one of said intervals of time;

magnitude comparator means for comparing the magnitude of the output of said short-term storage means with the output of said multiplexed digital summer means to determine if the amplitude of said signals from said sensing means increases, is constant, or decreases;

long-term storage means for receiving and storing the output of said magnitude comparator means for a number of most recent successive intervals of time;

trend-decision logic means for receiving the output of said magnitude comparator means and counting each determination of increase, remain constant, and decrease in amplitude of the signals from the sensing means to form an average count of the amplitude of said signals, and for decoding said average count to represent the tendency of the amplitude of said signals to increase, decrease or remain constant; and threat-decision logic means for receiving the outputs from said interval-magnitude logic means, said long-term storage means, and said trend-decision logic means, and for activating an alarm system, having a number of levels of alarm, to indicate increasing and decreasing amounts of said particulate matter in the environment, said amounts corresponding to an increasing and decreasing threat of fire.

* * * * *